US011787520B2

(12) United States Patent
Stimmel et al.

(10) Patent No.: US 11,787,520 B2
(45) Date of Patent: Oct. 17, 2023

(54) JET PUMP ASSEMBLY AND METHOD OF SECURING JET PUMP ASSEMBLY TO BOAT HULL

(71) Applicant: Tennessee Propulsion Products, LLC, Orlando, FL (US)

(72) Inventors: Jason C. Stimmel, Eads, TN (US); Patricia Owens, Covington, TN (US)

(73) Assignee: Tennessee Propulsion Products, LLC, Orlando, FL (US)

( * ) Notice: Subject to any disclaimer, the term of this patent is extended or adjusted under 35 U.S.C. 154(b) by 199 days.

(21) Appl. No.: 17/550,365

(22) Filed: Dec. 14, 2021

(65) Prior Publication Data

US 2023/0182878 A1 Jun. 15, 2023

(51) Int. Cl.

| | |
|---|---|
| ***B63H 11/01*** | (2006.01) |
| ***B63H 11/08*** | (2006.01) |
| ***B63H 21/30*** | (2006.01) |
| ***B63H 11/10*** | (2006.01) |
| ***B63H 11/11*** | (2006.01) |

(52) U.S. Cl.

CPC ..... *B63H 11/01* (2013.01); *B63H 11/08* (2013.01); *B63H 11/101* (2013.01); *B63H 21/30* (2013.01); *B63H 11/11* (2013.01); *B63H 2011/081* (2013.01)

(58) Field of Classification Search

CPC ..... B63H 11/00; B63H 11/01; B63H 11/08; B63H 11/101; B63H 11/11; B63H 11/113; B63H 2011/081; B63H 20/02; B63H 21/30

USPC ..... 440/38, 46

See application file for complete search history.

(56) References Cited

U.S. PATENT DOCUMENTS

| | | | | |
|---|---|---|---|---|
| 4,942,838 | A | 7/1990 | Boyer et al. | |
| 4,964,821 | A | 10/1990 | Tafoya | |
| 6,267,633 | B1 * | 7/2001 | Suganuma | B63H 11/11 440/41 |
| 6,406,339 | B1 * | 6/2002 | Sills | B63H 11/107 440/38 |
| 7,182,033 | B1 | 2/2007 | Phillips et al. | |
| 7,185,599 | B1 | 3/2007 | Griffiths et al. | |
| 8,480,444 | B2 | 7/2013 | Mataya | |
| 10,486,786 | B1 | 11/2019 | Kimball | |
| 10,787,237 | B2 | 9/2020 | Kimball | |
| 10,933,965 | B2 | 3/2021 | Kimball | |
| 2006/0228959 | A1 | 10/2006 | Ruiz | |
| 2007/0283869 | A1 | 12/2007 | Quinn | |
| 2020/0369357 | A1 | 11/2020 | Kimball | |
| 2021/0147055 | A1 | 5/2021 | Kimball et al. | |

FOREIGN PATENT DOCUMENTS

WO 2016147102 A2 9/2016

* cited by examiner

*Primary Examiner* — Daniel V Venne

(74) *Attorney, Agent, or Firm* — Allen, Dyer, Doppelt & Gilchrist, P.A.

(57) ABSTRACT

A jet pump assembly includes a marine engine, a jet drive and a shield adapted to be secured to a transom of a watercraft. The shield has arms to which the marine engine is secured and legs to which the jet drive is secured, the arms and legs extending in opposite directions. The shield has a flange adapted to be secured to the transom of the watercraft. The shield covers an opening in the transom through which the jet pump assembly is passed during assembly. A gasket between the shield and transom prevents water from entering the watercraft.

20 Claims, 12 Drawing Sheets

JET PUMP ASSEMBLY AND METHOD OF SECURING JET PUMP ASSEMBLY TO BOAT HULL

TECHNICAL FIELD

The present invention relates generally to jet pumps for watercraft, and more particularly, to a jet pump assembly for watercraft having a compact modular "plug and play" configuration for installation through a transom of the watercraft with a substantial portion of the jet pump assembly configured to be positioned external to the transom.

BACKGROUND

Jet pumps for watercraft such as motorboats typically require multiple hours to completely install the jet pump in the hull of the motorboat along with an engine for powering the jet pump and a separate exhaust system for directing exhaust from the engine to an exterior of the motorboat. For example, it may take between approximately 5 and 7 hours for a technician to complete such an installation. In addition, the technician is typically required to drill a large quantity of holes through the hull of the boat to accommodate various components of the jet pump and the exhaust system. In one example, approximately 67 holes and fasteners may be needed. In addition to contributing to the amount of time required to complete installation, each hole through the hull creates an undesirable opportunity for leakages to occur during use of the motorboat.

Leaking and alignment issues are also known to occur at or near the interface between the jet pump and the hull of the motorboat.

Undesirable vibrations are also frequently transferred between the jet pump and the hull of the motorboat and may result in damage to components and/or cargo of the motorboat, and/or discomfort to passengers of the motorboat.

Moreover, conventional jet pumps are typically configured for use in a single size or class of watercraft, such that a jet pump configured for use in a watercraft of a first size may not be compatible with a watercraft of a second size.

Accordingly, there is a need for a jet pump assembly for use in a watercraft that overcomes these and other deficiencies of conventional jet pumps.

There is further a need for a jet pump assembly that may be quickly and easily installed in a watercraft.

There is further a need for a method of installation of a jet pump assembly in a watercraft that is quick and easy.

SUMMARY

According to an exemplary embodiment of the invention, a jet pump assembly for a watercraft includes three principal components: a marine engine, a jet drive including a rotatable shaft configured to receive torque from the marine engine and a shield adapted to be secured to the hull of the watercraft. The watercraft may be any conventional watercraft including a pontoon boat. The jet pump assembly may be quickly and easily assembled outside the watercraft before being secured to the watercraft.

In one embodiment, the shield is a unitary member having two parallel arms to which the marine engine is secured and two parallel legs to which the jet drive is secured. The shield may have a removable cover to allow a person to access inside a hollow interior of the shield without having to remove the shield from the hull of the watercraft. The shield is secured to the transom of the watercraft such that the parallel legs and central portion of the shield are behind the transom of the watercraft. The two parallel arms of the shield extend forwardly from the central portion of the shield in a direction opposite the direction of the legs of the shield. The shield has a flange extending around its perimeter which has spaced openings. The openings in the flange of the shield are sized to receive fasteners which secure the shield to the transom of the watercraft. In some embodiments, two parallel hollow legs of the shield extend in an opposite direction from two parallel hollow arms of the shield. However, the shield may have any other number of legs and/or arms to assist in the securement or positioning of the marine engine or jet drive. The legs and/or arms may be partially or fully hollow. The shield is large enough to cover an opening in the transom of the watercraft. The opening in the transom of the watercraft is sized so that a portion of the marine engine may pass though the opening in the transom in the watercraft.

Upon assembly, a portion of the marine engine is located behind a plane defined by the transom of the watercraft. The plane defined by the transom of the watercraft is generally vertical but is not limited to a vertical orientation. In other embodiments, the marine engine may be entirely inside the interior of the watercraft in front of the transom of the watercraft.

The hull of the watercraft has an opening large enough so that the marine engine of the jet pump assembly may be passed through the opening prior to installation of the assembled jet pump assembly. The opening in the transom of the watercraft is sized to allow the marine engine to pass through the opening prior to the shield of the jet pump assembly being secured to the transom of the watercraft.

According to another aspect of the invention, the jet pump assembly comprises a marine engine, a jet drive including a rotatable shaft configured to receive torque from the marine engine and a shield. The marine engine and the jet drive are secured to the shield. The watercraft transom has an opening large enough to allow the marine engine of the jet pump assembly to be passed through the opening in the transom of the watercraft before the shield is secured to the transom of the watercraft, thereby preventing a waterproof seal around the opening in the transom of the watercraft. The shield has a flange around the perimeter which is adapted to be secured to the transom of the watercraft after at least a portion of the marine engine is passed though the opening in the transom of the watercraft. The shield is located behind the transom of the watercraft and covers the opening in the transom of the watercraft, thereby preventing water from entering the interior of the watercraft through the opening in the transom of the watercraft. The rotatable shaft of the jet drive extends through an opening in the shield.

The combination of watercraft and jet pump assembly may further include at least one gasket configured to be positioned between the transom of the watercraft and a flange of the shield. The at least one gasket or vibration isolator may be made of any known material such as rubber to dampen vibrations caused by the marine engine.

According to yet another aspect of the invention, a method of installing a jet pump assembly to a transom of a watercraft comprises securing a jet drive and a marine engine to a shield of the jet pump assembly. A portion of the jet drive extends through an opening in the shield and is secured to the marine engine so the marine engine may power the jet drive. The marine engine and jet drive may be coupled together outside the watercraft, thereby making assembly and installation of the jet pump assembly more simple and easier than heretofore known.

After the jet pump assembly is fully assembled, the marine engine of the jet pump assembly is passed at least partially through the opening in the transom of the watercraft until the gasket is sandwiched between the flange of the shield and the exterior surface of the transom of the watercraft. At this point fasteners are used to secure the shield of the jet pump assembly to the transom of the watercraft. The shield and gasket prevent water from entering the watercraft through the opening in the transom of the watercraft.

In assembling the jet pump assembly, the jet drive is secured to two hollow, parallel legs of the shield and the marine engine is secured to two hollow, parallel arms of the shield.

According to yet another aspect of the invention, a method of installing a jet pump assembly to a hull of a watercraft comprises building a jet pump assembly by securing a jet drive and a marine engine to a shield. The shield has an opening through which a portion of the jet drive extends. The marine engine is coupled to the jet drive to power the jet drive. The method further comprises passing a portion of the jet pump assembly through an opening in the transom of the watercraft and securing the shield to the transom of the watercraft. The portion of the jet pump assembly which is passed through the opening in the transom of the watercraft comprises at least a portion of the marine engine. The shield has a flange which is the part of the shield which is secured to the transom of the watercraft with spaced fasteners. A gasket is sandwiched between the transom of the watercraft and the flange of the shield to prevent water from leaking inside the shield and into the watercraft. In assembling the jet pump assembly, the jet drive is secured to two hollow parallel legs of the shield and the marine engine is secured to two hollow parallel arms of the shield.

The jet pump assembly of the present invention when installed on a watercraft allows easy access to the jet drive for service from outside the boat.

Another advantage of the jet pump assembly of the present invention is that a marine engine manufacturer may fully assemble the jet pump assembly without having to rely on a boat manufacturer to install the marine engine and jet pump or jet drive separately.

Another advantage of the jet pump assembly of the present invention is a boat manufacturer does not need to construct a special or custom hull to support a particular jet drive.

Various additional features and advantages of the invention will become more apparent to those of ordinary skill in the art upon review of the following detailed description of the illustrative embodiments taken in conjunction with the accompanying drawings.

BRIEF DESCRIPTION OF THE DRAWINGS

The drawings, which are incorporated in and constitute a part of this specification, illustrate embodiments of the invention and, together with the general description given above and the detailed description given below, explain the embodiments of the invention.

DETAILED DESCRIPTION

Figure 1:
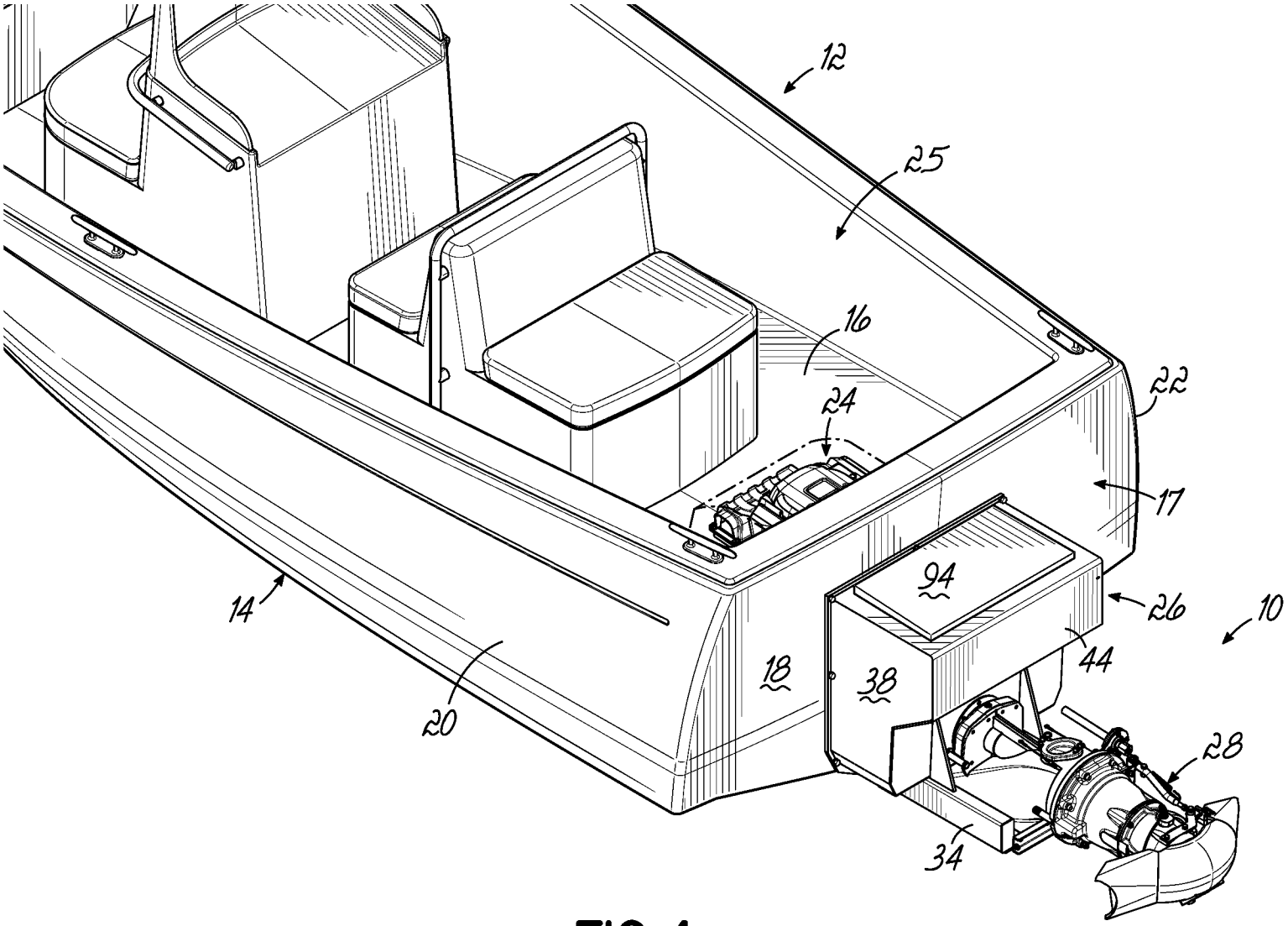
FIG. 1 is a perspective view of a watercraft including an exemplary jet pump assembly in accordance with the invention.

Referring now to FIG. 1, an exemplary jet pump assembly 10 according to an aspect of the invention is shown mounted to a watercraft 12. The watercraft 12 includes a hull 14 which has a bottom 16, a bow (not shown), a stern 17, a transom 18, a port side 20, and a starboard side 22, which collectively define an interior 25 of the watercraft. The jet pump assembly 10 may be operatively coupled to a transom 18 of the hull 14 as shown in FIG. 1 for supplying power to the jet pump assembly 10 to propel the watercraft 12 through the water.

As discussed in greater detail below, the jet pump assembly 10 may have a compact modular "plug and play" configuration for installation onto the transom 18 of the watercraft 12 with a substantial portion of the jet pump assembly 10 positioned external to the hull 14. The features of the jet pump assembly 10 are set forth in further detail below to clarify each of these functional advantages and other benefits provided in this disclosure.

Figure 4:
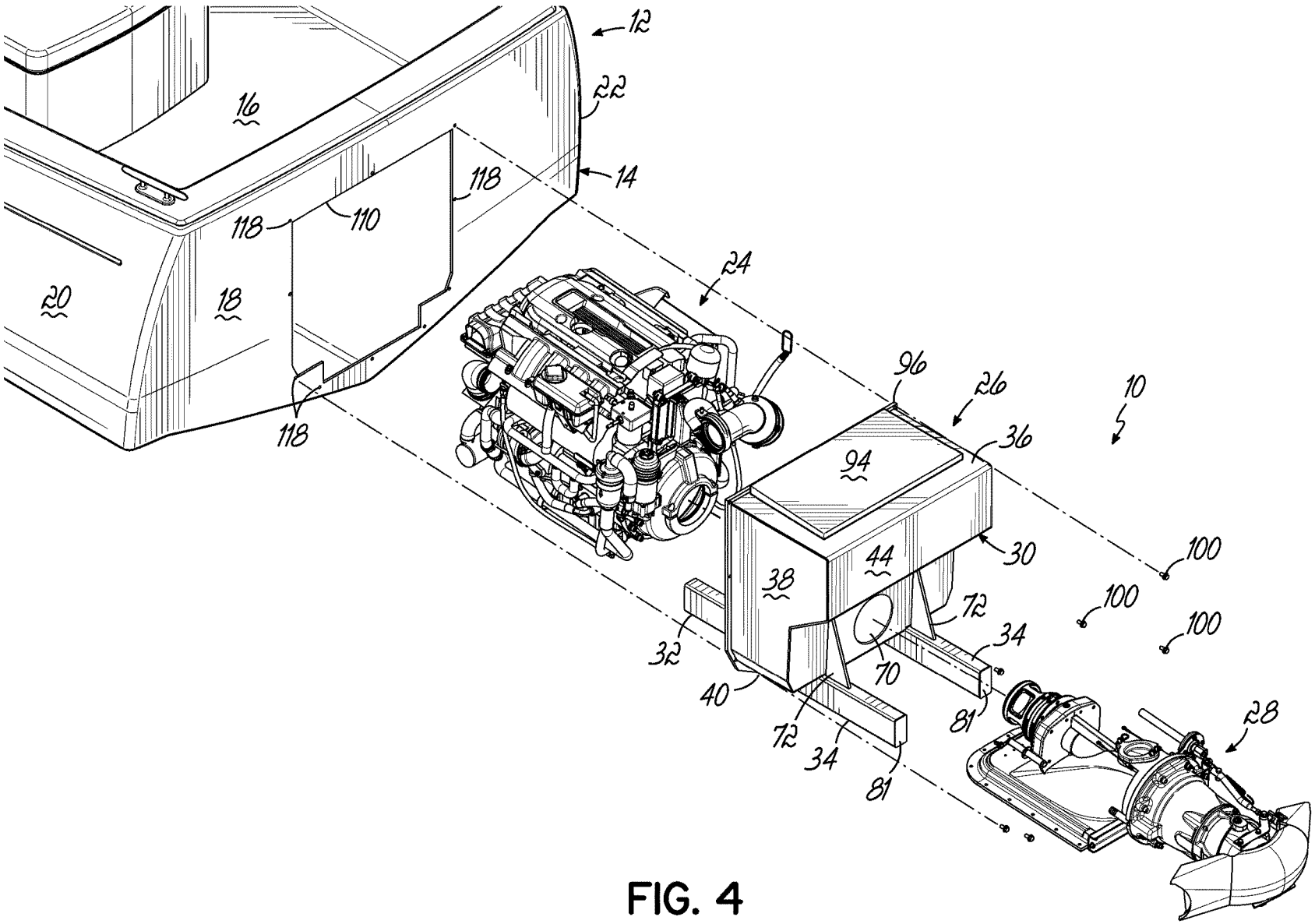
FIG. 4 is a perspective view of the jet pump assembly prior to assembly.

As best shown in FIG. 4, the jet pump assembly 10 comprises a marine engine 24, a shield 26 and a jet drive 28. Although one configuration of marine engine 24 is illustrated, any known marine engine may be used. The drawings are not intended to be limiting. Similarly, although one configuration of jet drive 28 is illustrated, any known jet drive may be used. Exemplary jet drives are disclosed in U.S. Pat. Nos. 10,486,786 and 10,787,237 which are fully incorporated herein.

Figure 6:
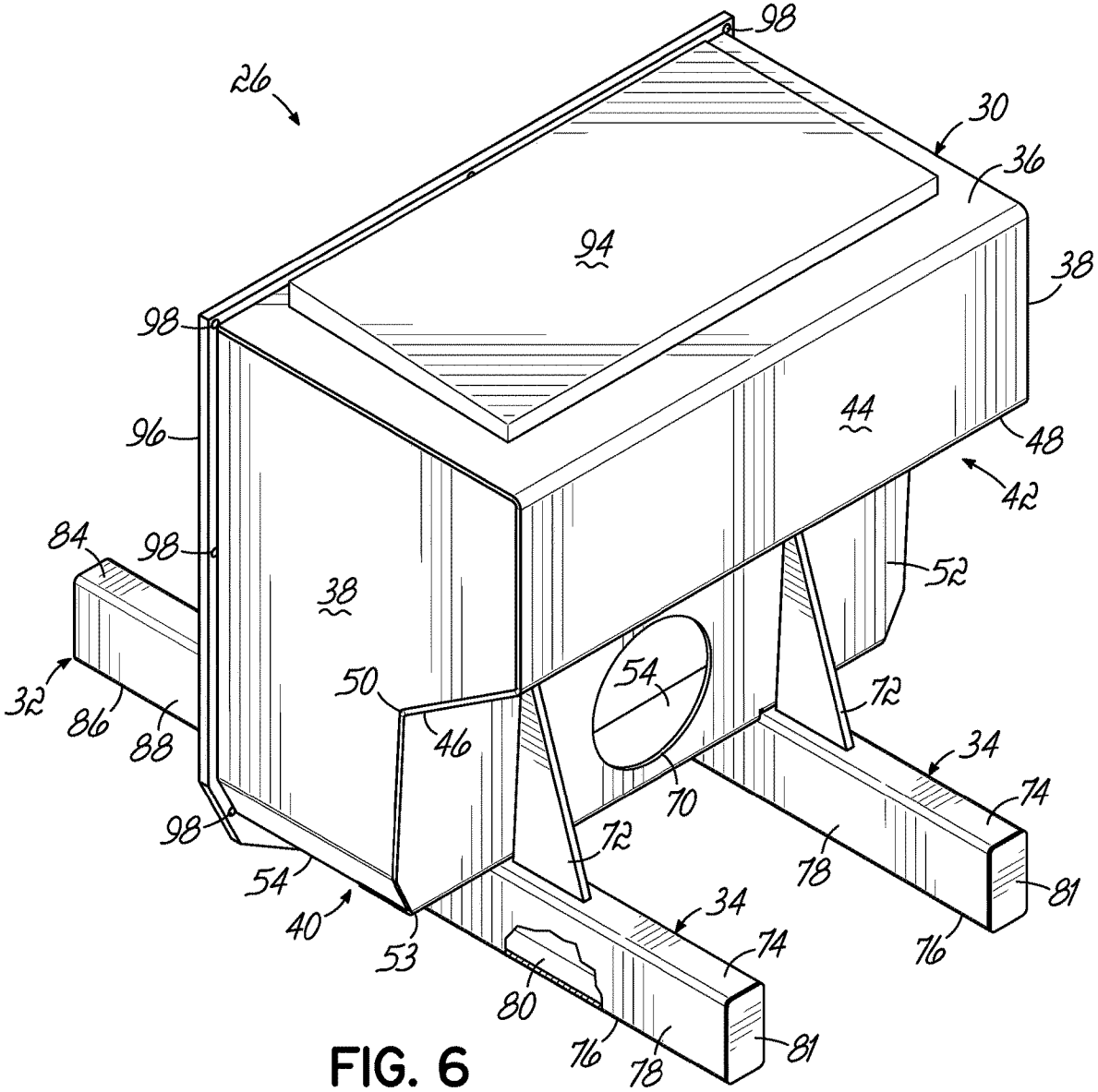
FIG. 6 is a rear perspective view of the shield of the jet pump assembly.
Figure 7:
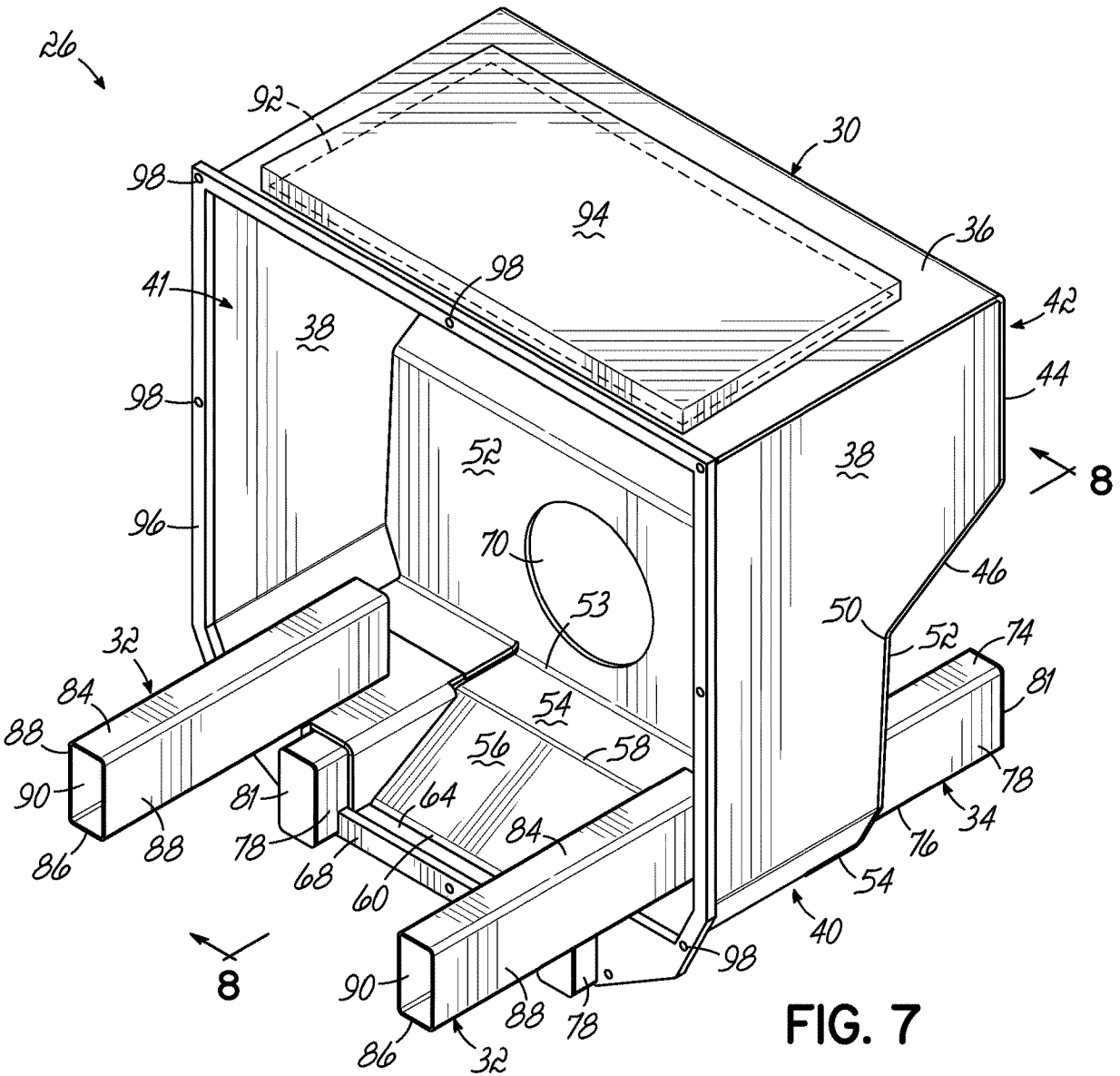
FIG. 7 is a front perspective view of the shield of the jet pump assembly.
Figure 8:
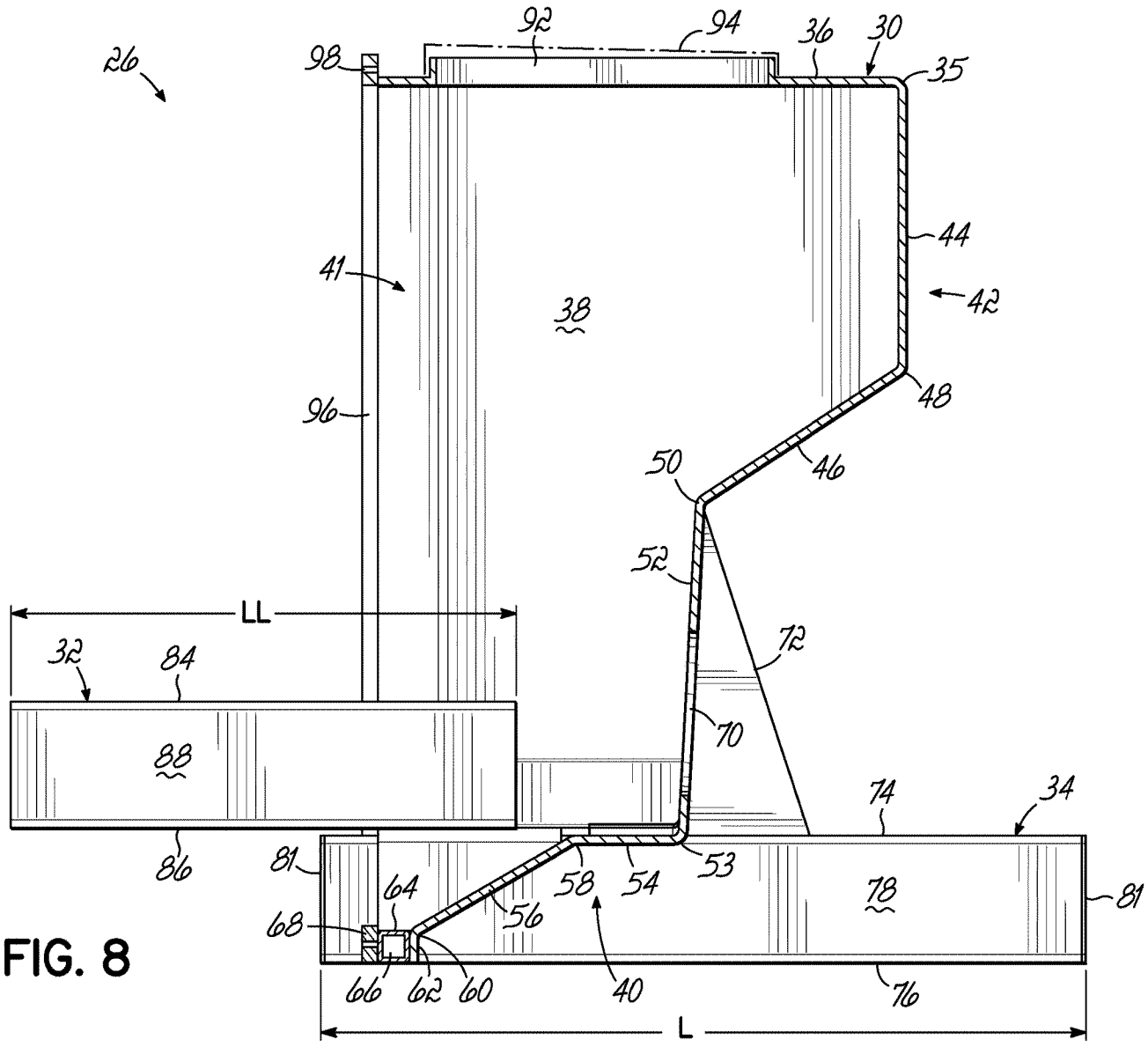
FIG. 8 is a side view of the shield of the jet pump assembly.

As best illustrated in FIGS. 6-8, one embodiment of shield 26 of the jet pump assembly 10 comprises a central portion 30, two arms 32 extending forwardly from the central portion 30 and two legs 34 extending rearwardly from the central portion 30. The central portion 30 of shield 26 includes a top 36, two sides 38, a bottom 40 and a rear 42 which define a hollow interior 41.

As best shown in FIG. 8, the top 36 of the shield 26 is bent downwardly along bend 35 to make the rear 42 of the shield 26. The rear 42 of the shield 26 has an upper portion 44 which is generally vertically oriented, a middle portion 46 which is sloped or inclined downwardly from bend 48 to bend 50, and a lower portion 52. The lower portion 52 of rear 42 of the shield 26 is slightly sloped or declined from bend 50 to bend 53. As best shown in FIGS. 6 and 7, a circular opening 70 is cut from the lower portion 52 of the rear 42 of the shield 26.

As best shown in FIGS. 7 and 8, the bottom 40 of the shield 26 has a front portion 54, a sloped portion 56 and a stub portion 62. The front portion 54 is generally horizontally oriented in the drawings extending from bend 53 to bend 58. The sloped portion 56 extends downwardly and forwardly from bend 58 to bend 60. As best shown in 8, from bend 60, the stub portion 62 is generally vertically oriented in the drawings. A stabilizer 64 having a hollow interior 66 is secured to the stub portion 62 of the bottom 40 of the shield 26. As best shown in FIG. 8, a bracket 68 is secured to the stabilizer 64.

As best shown in FIG. 8, the top 36 and bottom 40 of the shield 26 are illustrated as being made from the same piece of metal as the rear 42 of the shield 26. However, the top and/or bottom 40 of the shield 26 may be made from one or more different pieces of metal than the rear 42 of the shield 26. The portions of the shield including the sides 38 of the shield 26 may be made of any number of different pieces.

As best shown in FIG. 6, each leg 34 of the shield 26 is secured to the lower portion 52 of the rear 42 of the shield 30 with a triangular wedge 72 for stability and strength. Each wedge 72 is welded to the lower portion 52 of the rear 42 of the shield 26 and to an upper wall 74 of one of the legs 34 of the shield 26. As best shown in FIG. 6, each leg 34 of the shield 26 has an upper wall 74, a bottom wall 76 and two side walls 78 which define a hollow interior 80 and define a rectangular cross-sectional configuration. Each end of each leg 34 of the shield 26 has a cap 81 to prevent water from entering the hollow interior 80 of the leg 34 of the shield 26.

As best shown in FIG. 7, each arm 32 of the shield 26 has an upper wall 84, a bottom wall 86 and two side walls 88 which define a hollow interior 90 and define a rectangular cross-sectional configuration. As best illustrated in FIG. 8, each of the arms 32 of the shield 26 extends from the central portion 30 of the shield 26 in a direction opposite the direction of the legs 34 of the shield 26. As best shown in FIG. 8, the length L of each of the arms 34 of the shield 26 is identical. Similarly, the length LL of each of the legs 32 of the shield is identical. However, the length L of the arms 34 is greater than the length L of the legs 32 of the shield 26.

As seen in the drawings, the top 36 of the shield 26 has an opening 92 cut out therefrom. The opening 92 is covered with a removable cover 94 to allow access to the interior 41 of the shield 26 for purposes of replacing or repairing portions of the marine engine 24.

The shield 26 of the jet pump assembly 10 may be constructed of aluminum, fiberglass and/or composite. For example, certain components of the shield 26 of jet pump assembly 10 may be constructed of cast aluminum. It will be appreciated that the shield 26 of the jet pump assembly 10 may be constructed of any suitable material which is waterproof.

Figure 2:
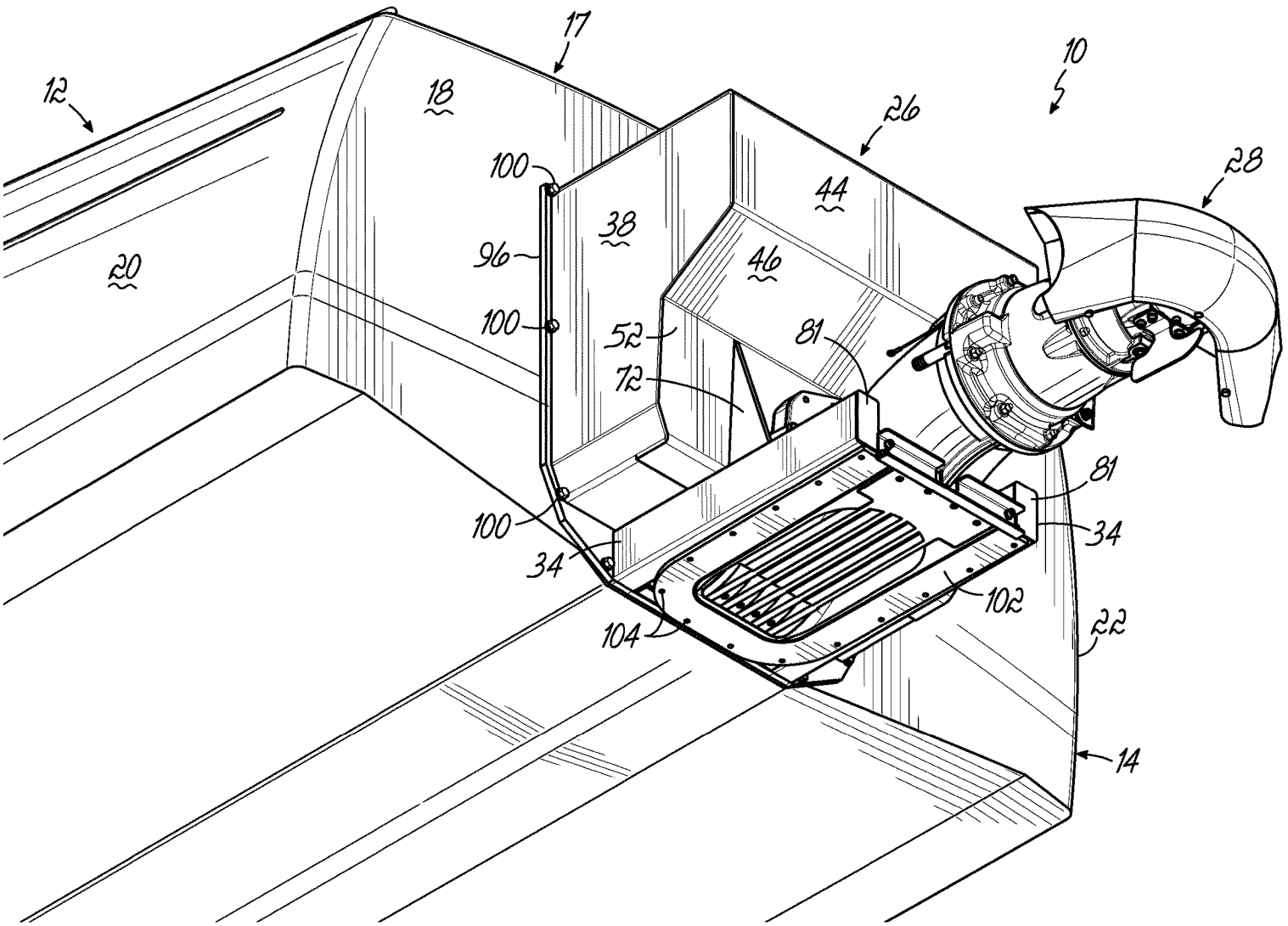
FIG. 2 is a magnified bottom perspective view of a portion of the jet pump assembly of FIG. 1, showing the shield of the jet pump assembly secured to the transom of the watercraft.

As best shown in FIG. 6, the shield 26 of the jet pump assembly 10 has a flange 96 extending around its perimeter. More particularly, the flange 96 extends upwardly from the top 36 of the shield 26, outwardly from the sides 34 of the shield 26 and downwardly from the bottom 40 of the shield 26. Holes 98 are formed through the flange 96 at select spaced locations and sized to allow bolts 100 to pass therethrough. As best shown in FIG. 2, the bolts 100 extend through the holes 98 in the flange 96 of the shield 26, through openings 116 in the gasket 114, through openings 118 in the transom 18 of the watercraft 12 and are tightened using nuts 120 with washers 122 between the nuts 120 and bolts 100 to secure the jet pump assembly 10 to the watercraft 12.

As shown in FIG. 2, when the jet pump assembly is fully assembled, the jet drive 28 is secured to the two legs 34 of the shield 28. More specifically, a grate 102 of the jet drive 28 is secured with fasteners 104 to the bottom walls 76 of the legs 34 of the shield 28. However, any other portion(s) of any known jet drive may be secured to the legs 34 of the shield 28 to secure the jet drive 28 to the shield.

Figure 9:
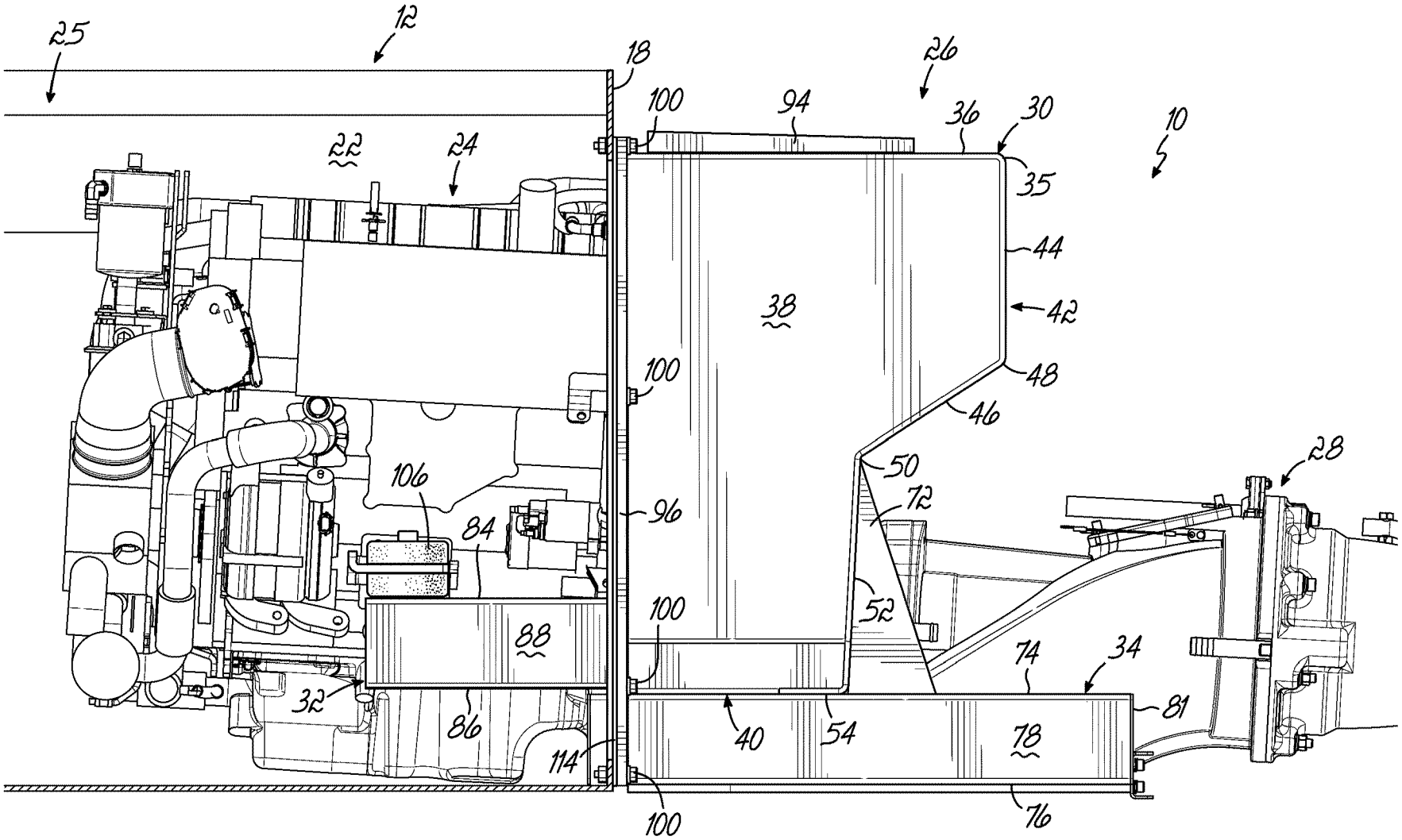
FIG. 9 is a side view of the jet pump assembly secured to the transom of the watercraft.

As shown in FIG. 9, when the jet pump assembly is fully assembled, the marine engine 24 is secured to the two arms 32 of the shield 28. More specifically, the marine engine 24 is secured with bushings (only one shown) 106 to the arms 32 of the shield 28. However, any other portion(s) of any known marine engine may be secured to the arms 32 of the shield 28 to secure the jet drive 28 to the shield 28.

Figure 5A:
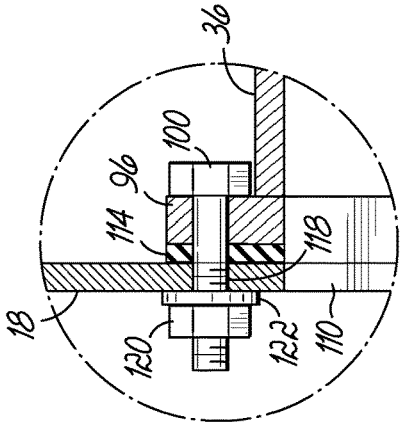
FIG. 5A is an enlarged view of the encircled area 5A of FIG. 5, showing a gasket sandwiched between the shield and the transom of the watercraft.
Figure 5:
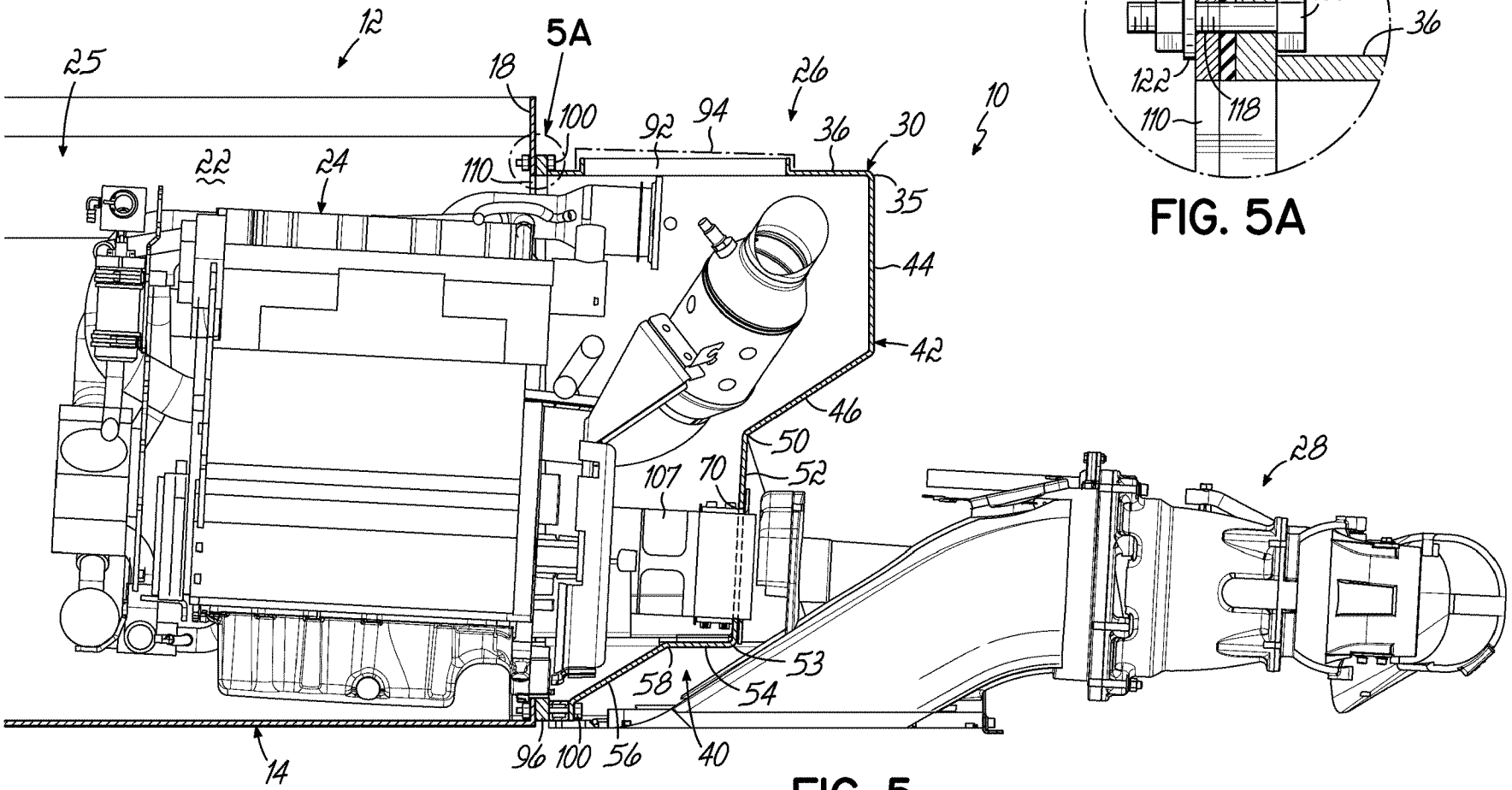
FIG. 5 is a side view showing the jet pump assembly secured to the transom of the watercraft.

Referring now to FIGS. 4-5, a method of constructing a jet pump assembly and installing the jet pump assembly 10 onto the transom 18 of the watercraft 12 is provided. Initially, as shown in FIG. 4, the jet drive 28 is secured to the shield 26 and more specifically to the two parallel legs 34 of the shield 26. The marine engine 24 is secured to two parallel arms 32 of the shield 26. Additionally, as shown in FIG. 5, a drive shaft 108 of the jet drive 28 is passed through circular opening 70 in the shield 26 and coupled to the marine engine 24 to provide power to the jet drive 28 upon operation.

Figure 4A:
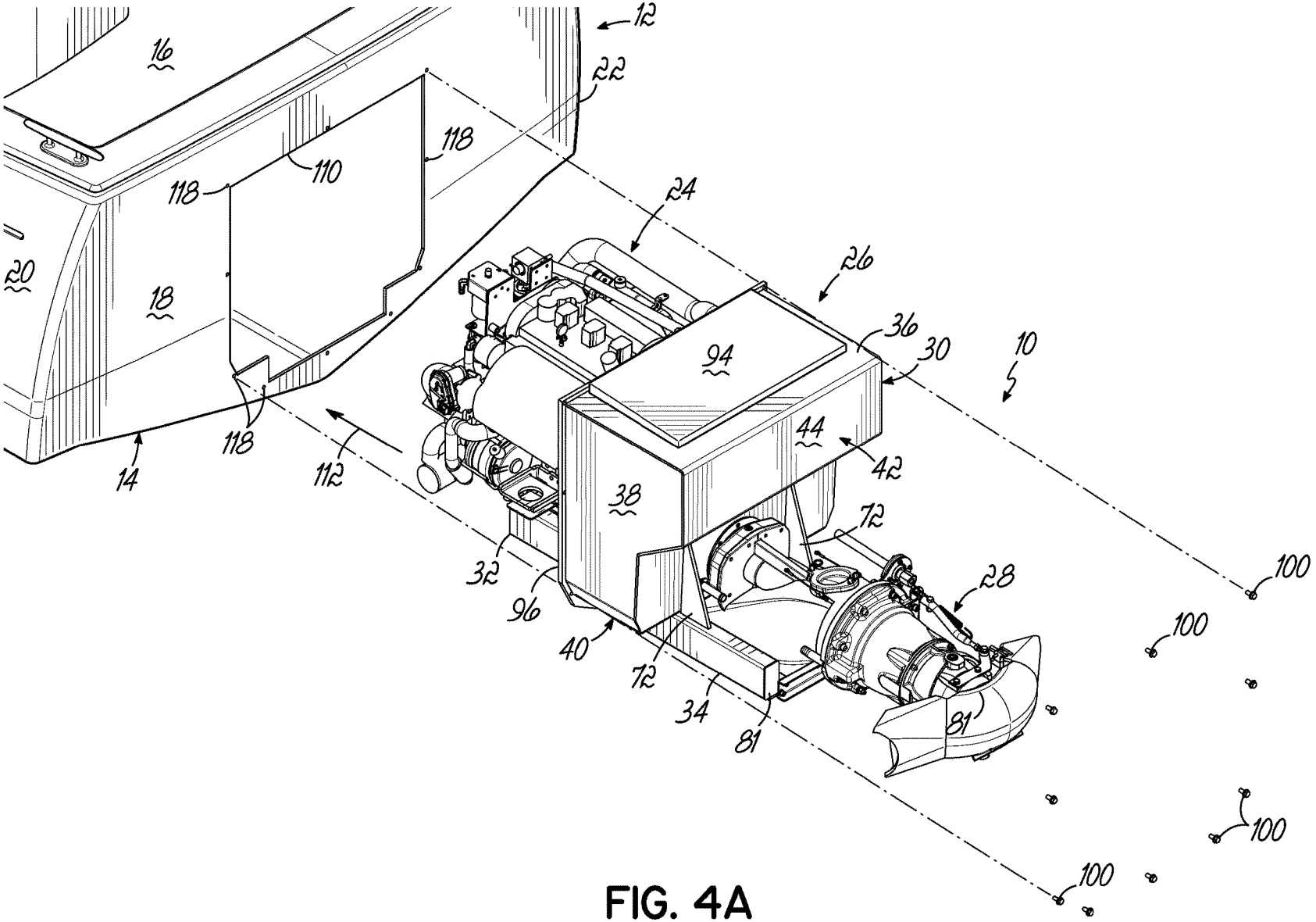
FIG. 4A is a perspective view of the assembled jet pump assembly prior to the shield of the jet pump assembly being secured to the transom of the watercraft.

After the jet pump assembly 10 is fully assembled, the assembled jet pump assembly 10 is passed partially through an opening 110 in the transom 18 of the hull 14 of the watercraft 12. See FIG. 4A. As shown in FIG. 4A, the assembled jet pump assembly 10 is oriented as shown and moved in the direction of arrow 112 such that a portion of the marine engine 24 extends through the opening 110 in the transom 18 of the hull 14 of the watercraft 12. The opening 110 is cut out of the transom 18 of the hull 14 of the watercraft 12 prior to installation of the jet pump assembly 10. The opening 110 is large enough to enable at least a portion of the marine engine 24 of the assembled jet pump assembly 10 to pass therethrough. The assembled jet pump assembly 10 does not need to be lifted over the transom 18 for assembly. In addition, the presence of the opening 110 enables the jet pump assembly 10 to be constructed prior to securement to the hull 14 of the watercraft 12.

As shown in FIG. 4A, the assembled jet pump assembly 10 is moved towards the bow of the watercraft or forwardly in the direction of arrow 112 such that a portion of the marine engine 24 extends through the opening 110 in the transom 18 of the hull 14 of the watercraft 12. The assembled jet pump assembly 10 is moved further forwardly until a gasket 114 is sandwiched between the transom 18 of the hull 14 of the watercraft 12 and the flange 96 of the shield 26 contacts the exterior surface of the transom 18 of the hull 14 of the watercraft 12. As shown in FIGS. 5 and 5A, the gasket 114 sandwiched between the transom 18 of the watercraft 12 and the flange 96 of the shield 26 prevents water from leaking inside the shield 26 and into the watercraft 12.

As shown in FIGS. 5 and 5A, after the assembled jet pump assembly 10 is properly located with the shield 26 covering the opening 110 in the transom 18 of the watercraft 12, fasteners 100 are passed through the openings 98 in the flange 96 of the shield 26, through openings 118 in the gasket 114 and through openings 118 in the transom 18 of the watercraft 12. The fasteners 100 pass through washers 122 and nuts 120 are threaded onto the fasteners 100.

Although the drawings show one size and shape of opening 110 in the transom 18 of the hull 14, the drawings are not intended to be limiting. The opening 110 in the transom 18 of the hull 14 may be any desired shape such that the opening 110 allows at least a portion of the marine engine 24 of the assembled jet pump assembly 10 to fit through the opening 110 in the transom 18 of the watercraft 12.

Figure 10:
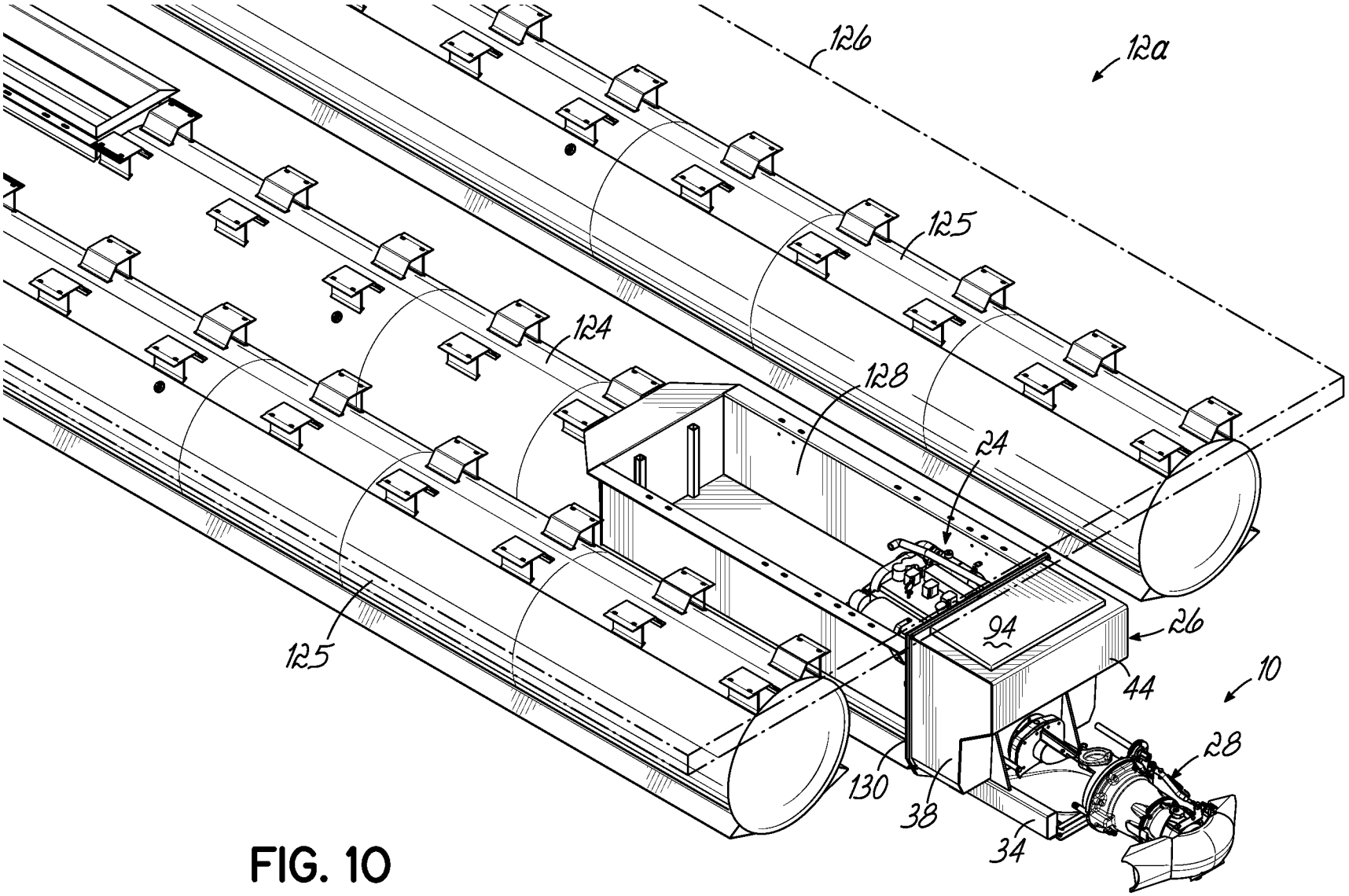
FIG. 10 is a perspective view of a portion of a pontoon boat having three toons, the middle toon having a jet pump assembly installed according to a method disclosed herein.
Figure 11:
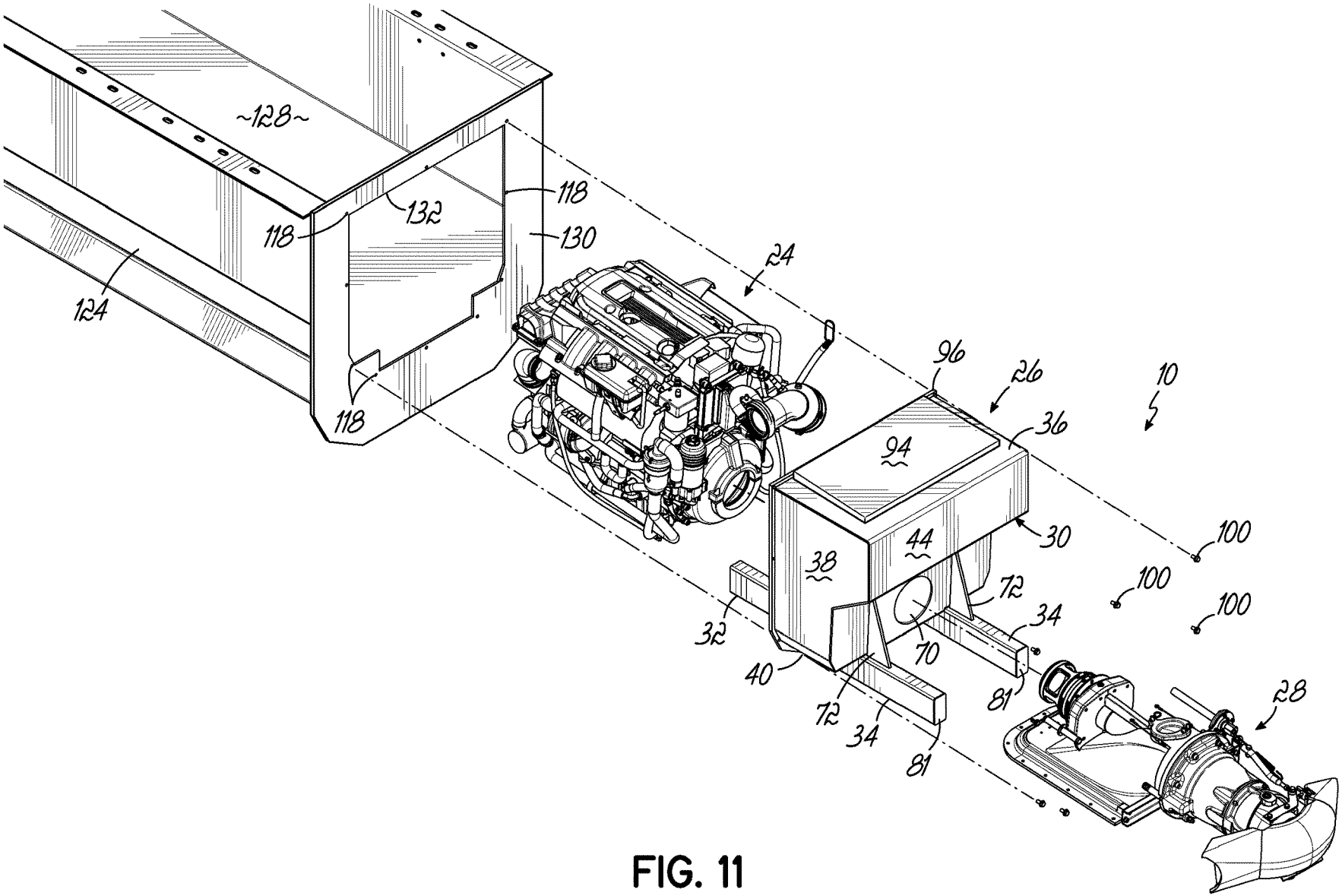
FIG. 11 is a perspective view of the jet pump assembly being put into the middle toon of the pontoon boat of FIG. 10.

FIGS. 10 and 11 illustrate one type of watercraft in the form of a tritoon boat 12*a*. As shown in FIG. 10, the tritoon boat 12*a* has two outer toons 125 and a middle toon 124. A deck 126 may be secured to some or all three of the toons 124, 125 in any known manner. Although one type of outer toon 125 is illustrated, any known outer toon may be used. The drawings are not intended to be limiting. Similarly, although one type of middle toon 124 is illustrated, any known middle toon may be used. The drawings are not intended to be limiting. The deck 126 is shown generally and not intended to be limited in any way. Any known deck 126 may be used.

Middle toon 124 has a cavity 128 adapted to receive a gasoline tank (not shown) at the rear thereof. As shown in FIG. 11, the cavity 128 has a transom 130 in which an opening 132 is formed (like opening 110 formed in the transom 18 of watercraft 12 shown in FIG. 4). A jet pump assembly 10 is attached to the middle toon 124 through the opening 132 in the transom 130 of middle toon 124 in the same manner described above.

Although FIGS. 10 and 11 illustrate a tritoon watercraft 12*a*, the present invention may be used to manufacture a pontoon watercraft as well. Any watercraft incorporating floats or toons may have a jet pump assembly as described and shown herein. The jet pump assembly or assemblies may be installed in any such watercraft in accordance with any of the methods described and/or shown herein.

Figure 3:
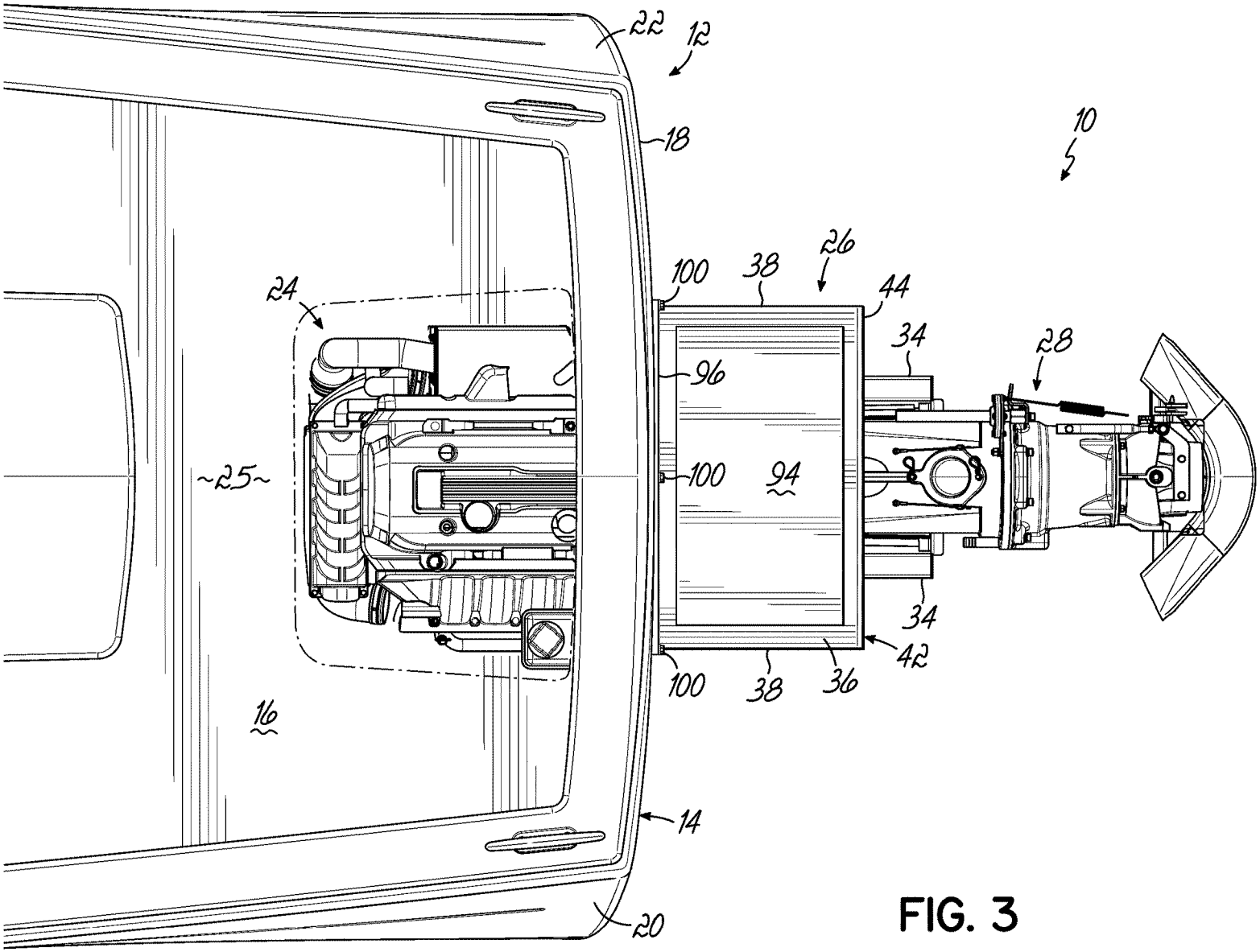
FIG. 3 is a top view of the jet pump assembly secured to the transom of the watercraft.

Accordingly, complete installation of the jet pump assembly 10 may be accomplished in a relatively short time as compared to conventional installation techniques. Moreover, by assembling the jet pump assembly 10 prior to securement to the transom 18 of the hull 14 of the watercraft 12, many of the difficulties associated with the current method of securing a jet pump to a watercraft are avoided. The jet pump assembly 10 may be assembled more easily and more quickly than the current method of assembling a portion of the jet pump assembly inside the watercraft including one having toons. As shown in FIGS. 1 and 3 when fully installed the marine engine 24 inside the interior 25 of the watercraft 12 may be covered with a cover shown in dashed lines for safety.

While the present invention has been illustrated by the description of specific embodiments thereof, and while the embodiments have been described in considerable detail, it is not intended to restrict or in any way limit the scope of the appended claims to such detail. The various features discussed herein may be used alone or in any combination. Additional advantages and modifications will readily appear to those skilled in the art. The invention in its broader aspects is therefore not limited to the specific details, representative apparatus and methods and illustrative examples shown and described. Accordingly, departures may be made from such details without departing from the scope of the general inventive concept.

What is claimed is:

1. A jet pump assembly for attachment to a transom of a watercraft, the jet pump assembly comprising:

a marine engine;

a jet drive including a rotatable shaft configured to receive torque from the marine engine; and a shield adapted to be secured to the transom of the watercraft, wherein the shield has parallel arms to which the marine engine is secured and parallel legs to which the jet drive is secured, the arms and legs of the shield extending in opposite directions, wherein the rotatable shaft extends through an opening in the shield.

2. The jet pump assembly of claim 1, wherein the shield has two arms to which the marine engine is secured and two legs to which the jet drive is secured.

3. The jet pump assembly of claim 2, wherein the arms and legs of the shield are hollow.

4. The jet pump assembly of claim 1, wherein a portion of the marine engine is behind a plane defined by the transom of the watercraft when the jet pump assembly is secured to the transom of the watercraft.

5. The jet pump assembly of claim 1, wherein the shield is large enough to cover an opening in the transom of the watercraft, the opening in the transom of the watercraft being large enough so the marine engine may pass through the opening in the transom of the watercraft.

6. The jet pump assembly of claim 1, wherein the shield has a removable cover.

7. The jet pump assembly of claim 1, wherein the shield has a flange which has openings through which fasteners extend to secure the shield to the transom.

8. In combination, a watercraft and a jet pump assembly, the combination comprising:

a watercraft having a transom with an opening therein, a jet pump assembly comprising:

a marine engine;

a jet drive including a rotatable shaft configured to receive torque from the marine engine; and a shield secured to the transom of the watercraft and located behind the transom of the watercraft, the shield having two hollow parallel legs to which the jet drive is secured and two hollow parallel arms to which the marine engine is secured, wherein the rotatable shaft extends through an opening in the shield and the shield covers the opening in the transom of the watercraft.

9. The combination of claim 8, wherein the shield has a flange coupled to an exterior surface of the transom of the watercraft and a gasket is located between the flange and the exterior surface of the transom of the watercraft.

10. The combination of claim 8, wherein the shield has an interior cavity and a portion of the marine engine is located inside the interior cavity of the shield.

11. The combination of claim 8, wherein a grate of the jet drive is secured to the hollow parallel legs of the shield.

12. A method of installing a jet pump assembly to a watercraft, the method comprising:

securing a jet drive and a marine engine to a shield;

passing the marine engine at least partially through an opening in a transom of the watercraft; and securing a flange of the shield to a transom of the watercraft.

13. The method of claim 12, further comprising:

sandwiching a gasket between the flange of the shield and the transom of the watercraft.

14. The method of claim 12, wherein securing the jet drive to the shield comprises securing the jet drive to two hollow parallel legs of the shield.

15. The method of claim 12, wherein securing the marine engine to the shield comprises securing the marine engine to two hollow parallel arms of the shield.

16. A method of installing a jet pump assembly to a watercraft, the method comprising:

building a jet pump assembly by securing a jet drive and a marine engine to a shield, the shield having an opening through which a portion of the jet drive extends, the marine engine being coupled to the jet drive to power the jet drive;

passing a portion of the jet pump assembly through an opening in a transom of the watercraft; and securing the shield to the transom of the watercraft.

17. The method of claim 16, wherein securing the shield to the transom of the watercraft comprises securing a flange of the shield to the transom of the watercraft.

18. The method of claim 17, further comprising securing a gasket between the flange of the shield and the transom of the watercraft.

19. The method of claim 16, wherein securing the jet drive to the shield comprises securing the jet drive to two hollow parallel legs of the shield.

20. The method of claim 16, wherein passing a portion of the jet pump assembly through the opening in the transom of the watercraft comprising passing at least a portion of the marine engine through the opening in the transom of the watercraft.

* * * * *